US010111486B2

(12) United States Patent
Gotti

(10) Patent No.: US 10,111,486 B2
(45) Date of Patent: Oct. 30, 2018

(54) SIZE ADJUSTER FOR HELMETS FOR CYCLING USE WITH COMFORTABLE FIT

(71) Applicant: KASK S.r.l., Chiuduno (BG) (IT)

(72) Inventor: Angelo Gotti, Nembro (IT)

(73) Assignee: KASK S.R.L., Chiuduno (BG) (IT)

( * ) Notice: Subject to any disclaimer, the term of this patent is extended or adjusted under 35 U.S.C. 154(b) by 2 days.

(21) Appl. No.: 14/331,424

(22) Filed: Jul. 15, 2014

(65) Prior Publication Data

US 2015/0026871 A1 Jan. 29, 2015

(30) Foreign Application Priority Data

Jul. 23, 2013 (IT) ..... MI2013A001234

(51) Int. Cl.
*A42B 3/08* (2006.01)
*A42B 3/04* (2006.01)
*A42B 3/14* (2006.01)

(52) U.S. Cl.
CPC ..... *A42B 3/08* (2013.01); *A42B 3/0406* (2013.01); *A42B 3/14* (2013.01); *A42B 3/145* (2013.01)

(58) Field of Classification Search
CPC ..... A42B 3/085; A42B 3/145; A42B 3/0406; A42B 3/08; A42B 3/14
See application file for complete search history.

(56) References Cited

U.S. PATENT DOCUMENTS 3,444,560 A * 5/1969 Northup, Jr. ..... A42B 3/145 2/8.1
3,780,382 A * 12/1973 Boden ..... A42C 5/04 2/182.6
4,101,981 A * 7/1978 Boden ..... A42C 5/04 2/171.3
5,551,094 A * 9/1996 Navone ..... A42B 3/08 2/418
6,226,802 B1 5/2001 Sasaki et al.
2009/0222978 A1 9/2009 Fang
2010/0050324 A1 3/2010 Musal
2010/0095438 A1 4/2010 Moelker
2010/0235971 A1 9/2010 Ahlgren et al.
2010/0281604 A1 11/2010 Grim et al.

FOREIGN PATENT DOCUMENTS

CN 102421312 A 4/2012
KR 100548032 B 1/2006

OTHER PUBLICATIONS

Chinese Office Action for corresponding Chinese Application No. 201410352721.9, (15 pages) (dated Nov. 23, 2017).

* cited by examiner

*Primary Examiner* — Anna Kinsaul
(74) *Attorney, Agent, or Firm* — Lucas & Mercanti, LLP

(57) ABSTRACT

A size adjuster for helmets for cycling use of the type that can be fixedly connected inside a helmet for cycling use is disclosed. The size adjuster includes an annular structure arranged along the lower periphery of the helmet and is able to be switched between a minimum diameter configuration and a plurality of increased diameter configurations to allow the helmet to be worn by different sized users. The adjuster can include a manual switching device of the configuration of the annular structure and further includes headrest elements for a user connected to the annular structure in a freely orientable manner along at least one axis.

8 Claims, 8 Drawing Sheets

SIZE ADJUSTER FOR HELMETS FOR CYCLING USE WITH COMFORTABLE FIT

CROSS-REFERENCE TO RELATED APPLICATION

The present application claims the priority of Italian patent application No. MI2013A001234, filed on Jul. 23, 2013, the contents of which are incorporated herein by reference.

FIELD OF THE INVENTION

The present invention refers to a size adjuster for helmets for cycling use that offers a comfortable fit for the user wearing it.

BACKGROUND OF THE INVENTION

In general, a helmet for cycling use is very different from helmets used in automobiles or on motorcycles and usually it consists of a cap structure shaped so as to at least partially cover the head of a user and configured to protect it from bumps at the cranial portion substantially from the ocular arch up to the nuchal area, both on top and at the side.

In order to make such helmets adaptable to the various possible sizes, now there are size adjuster devices associated with the cap so that, by acting manually, it is possible to tighten the helmet on the head of the user.

In particular, such size adjusters comprise an annular structure, either closed or open in a U, arranged along the lower periphery of the cap of the helmet and able to be switched between a minimum diameter configuration and a plurality of increased diameter configurations to allow the helmet to be worn by different sized users.

The manual switching device of the configuration of the annular structure comprises a cogwheel element capable of acting on telescopic portions that form the annular structure. Disadvantageously, however, as the size varies by acting on the manual switching device, the helmet does not always sit comfortably on the head of the user.

The solution currently proposed is to equip the annular structure with support portions that, however, since they are fixed, only offer comfortable support for some sizes and not for all possible switching configurations.

SUMMARY OF THE INVENTION

The purpose of the invention is to make a size adjuster for helmets for cycling use that is an alternative to the known ones, offering, in particular, comfortable support for the user also as the size varies.

According to the general aspect of the invention, the size adjuster for helmets for cycling use of the present invention comprises headrest elements for a user fixedly connected to the annular structure in a freely orientable manner along at least one axis, preferably the axis passing through the annular structure.

In this way, also by acting on the manual switching device that extends or retracts the annular structure, the support elements are free to tilt to adapt in an optimal manner to the head in all configurations of the adjuster.

Further characteristics of the invention are highlighted by the dependent claims.

BRIEF DESCRIPTION OF THE DRAWINGS

The characteristics and advantages of a size adjuster for helmets for cycling use according to the present invention will become clearer from the following description, given as an example and not for limiting purposes, referring to the attached schematic drawings, in which:

FIGS. 6 and 7 show how the present invention can adapt to the different sizes of the user;

DETAILED DESCRIPTION OF THE INVENTION

Figure 1:
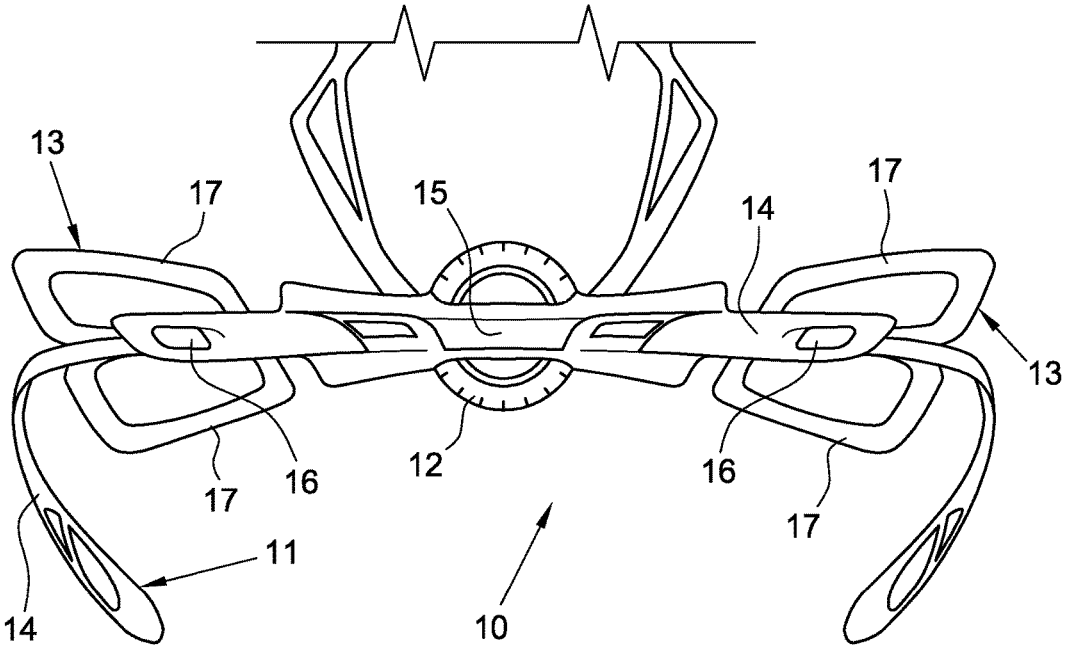
FIGS. 1 and 2 are internal and external views of the adjuster according to the present invention.
Figure 2:
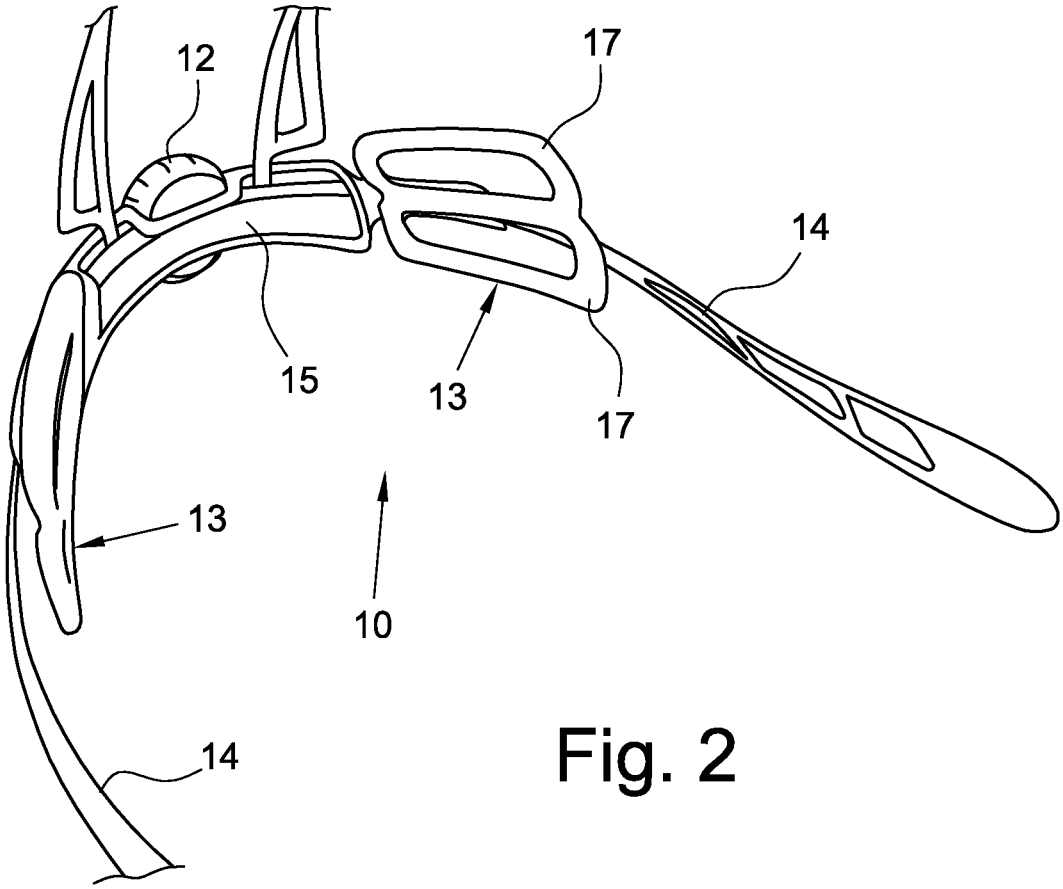
Figure 3:
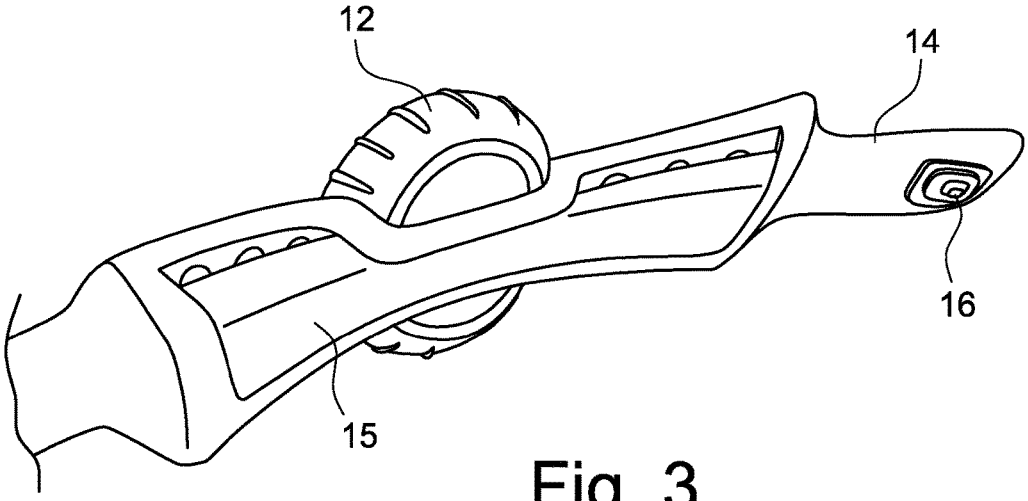
FIGS. 3-6 show details of the present invention.
Figure 4:
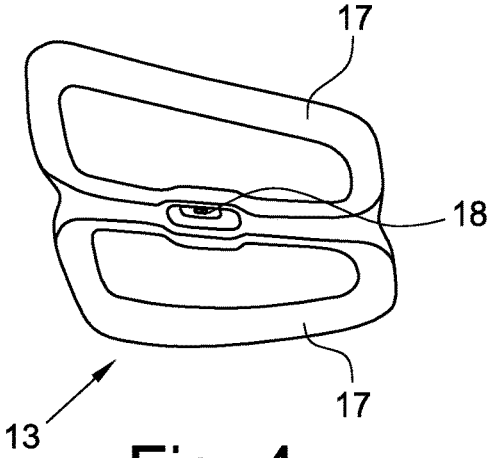
Figure 5:
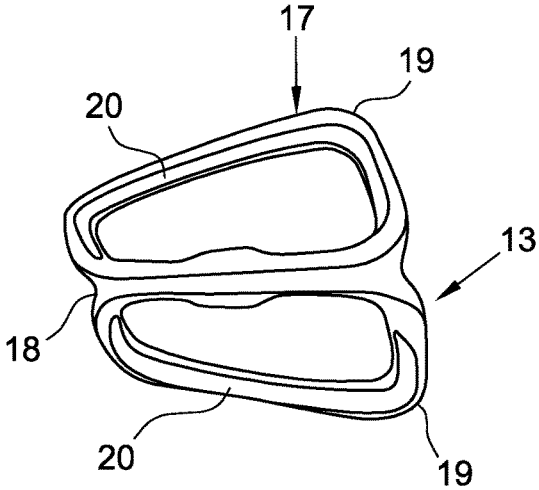

With reference to the figures, a size adjuster for helmets for cycling use according to the present invention is shown with 10.

Such a size adjuster for helmets for cycling use is of the type that can be fixedly connected inside a helmet for cycling use and comprising an annular structure 11 arranged along the lower periphery of the helmet.

The adjuster is able to be switched between a minimum diameter configuration and a plurality of increased diameter configurations to allow the helmet to be worn by different sized users.

An Annular structure 11 comprises both a structure that is effectively closed in a circle and a structure open in a U.

In the figures, the adjuster is shown only in part since the portions that are not shown are totally identical to those of the prior art.

The switching device 12 shown is also of the known and manual type.

In particular, the headrest elements 13 of the present invention are fixedly connected to the annular structure 11 in a freely orientable manner along at least one axis, preferably to the axis passing through the annular structure 11.

The annular structure 11 comprises two side arms 14 able to move telescopically with respect to a central portion 15 by acting on the manual switching device 12.

In this case, the headrest elements 13 are fixedly connected to the side arms 14.

Figure 11:
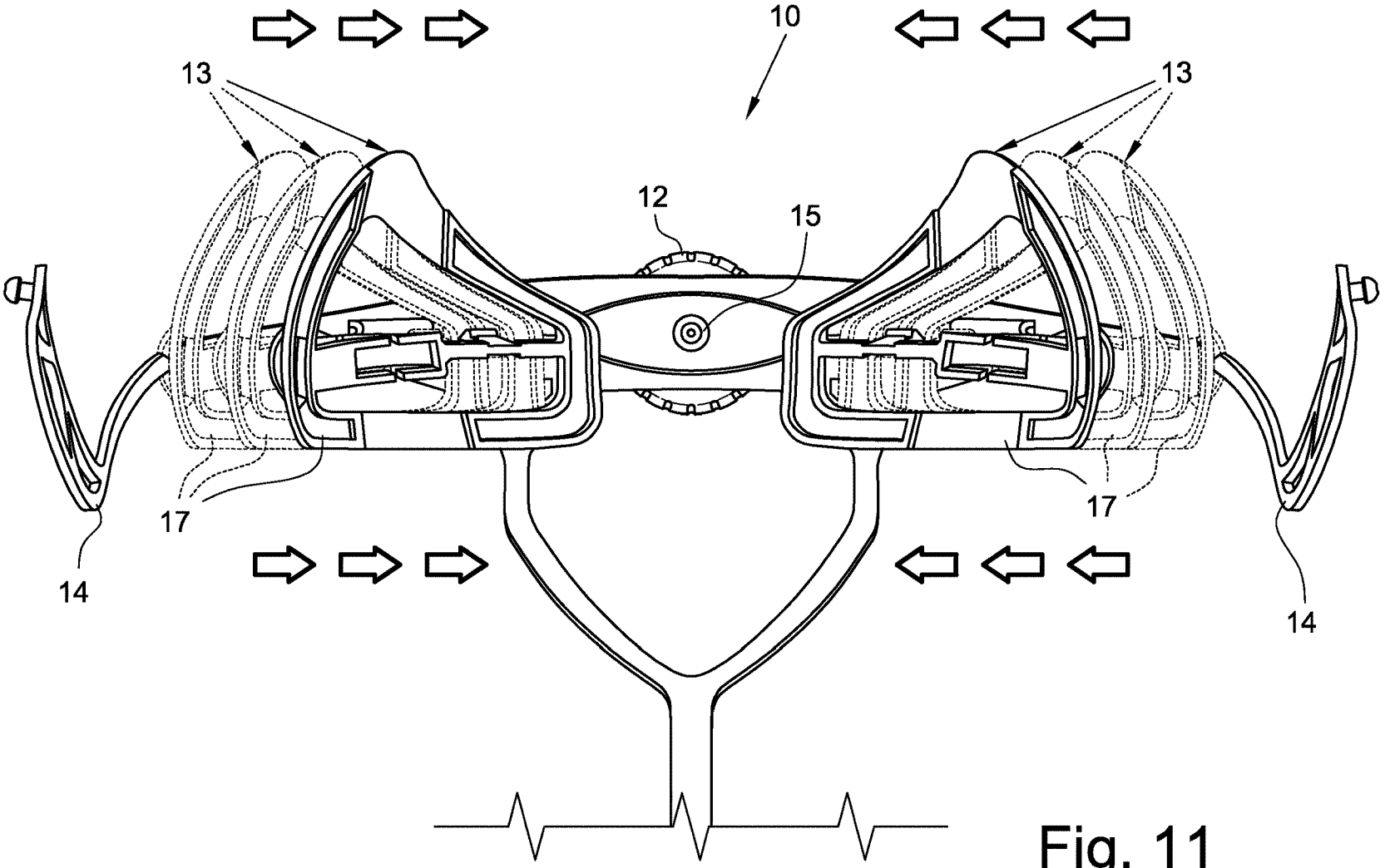
FIG. 11 shows another embodiment of the adjuster according to the present invention.

Alternatively, as shown in FIG. 11, the headrest elements 13 can be directly associated with the central portion 15.

In this case, the headrest elements 13 are able to move along the opposite side portions of the central portion 15 so as to be able to be fixedly connected in a plurality of positions different distances from the manual switching device 12.

According to a preferred embodiment, the headrest elements 13 are orientable along all axes in space being fixedly connected to the arms 14 through spherical supports 16.

According to the embodiment shown, the headrest elements 13 are shaped like a butterfly comprising two lobes 17 arranged on opposite sides with respect to the side arms 14.

In particular, the central portion 18 of the headrest elements 13, i.e. the portion arranged at the side arms 14, is made of rubber and has a recessed seat to facilitate the flexing about the axis passing through the side arms 14.

Figure 8:
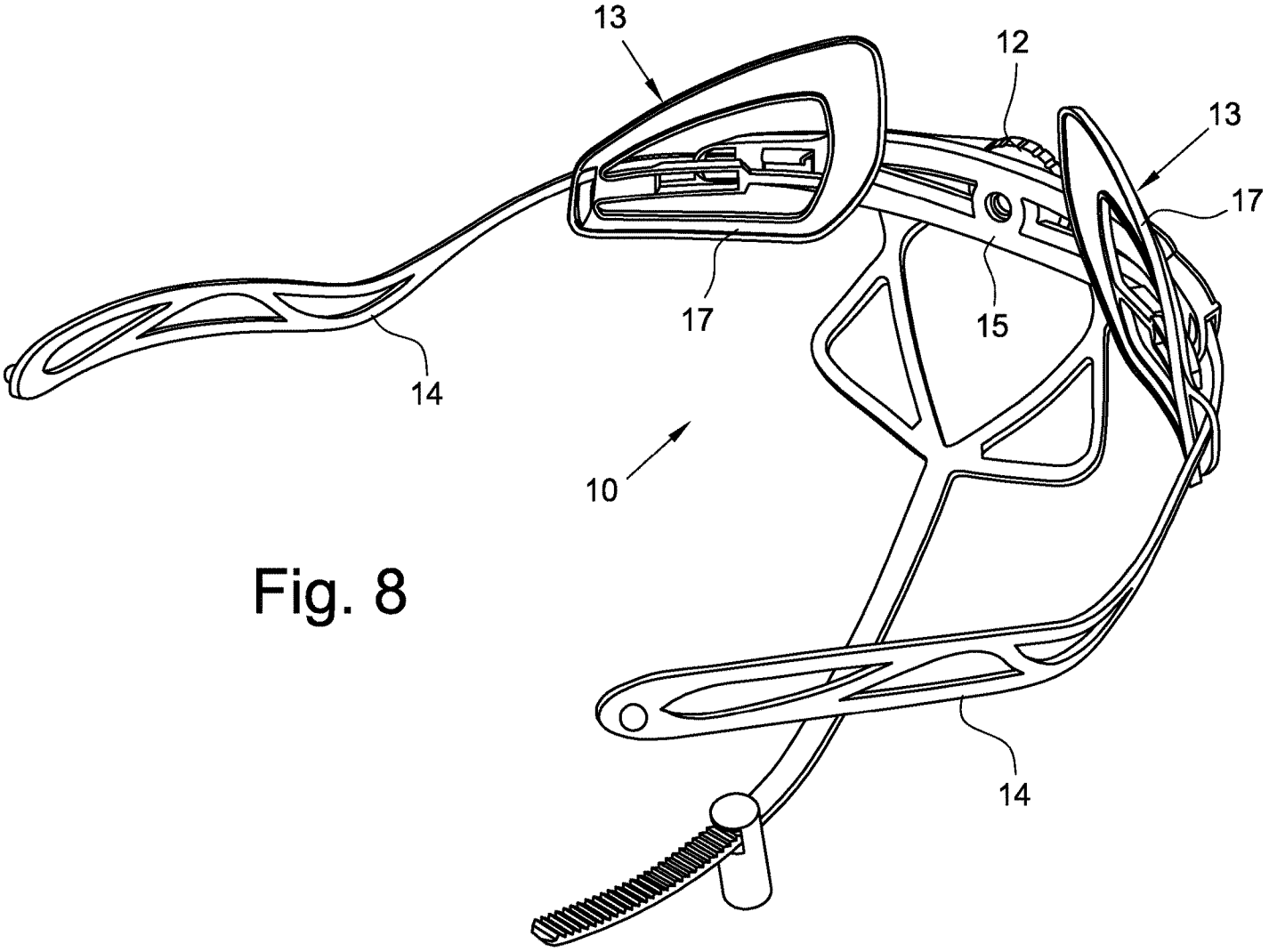
FIGS. 8-10 show another embodiment of the adjuster according to the present invention.
Figure 9:
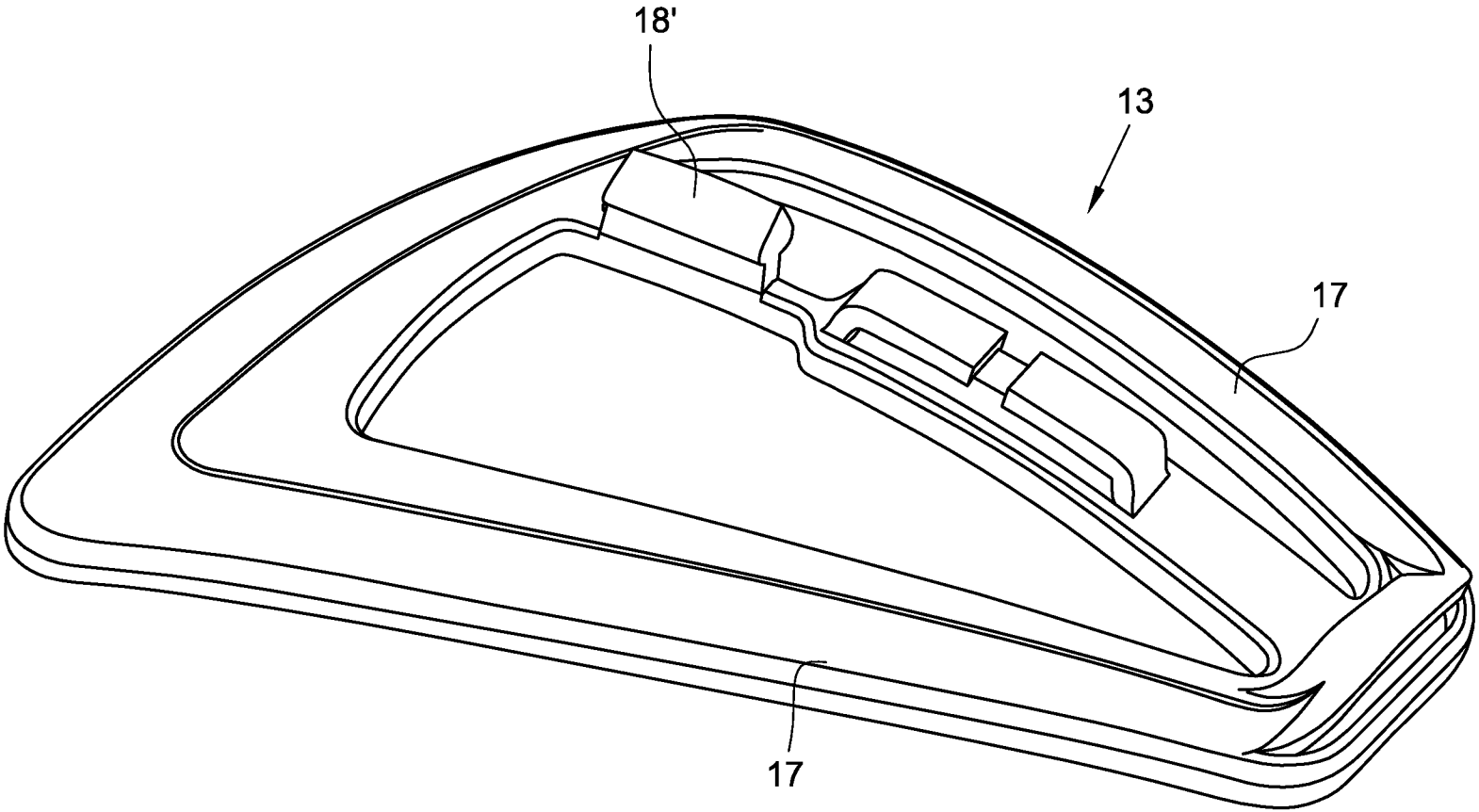
Figure 10:
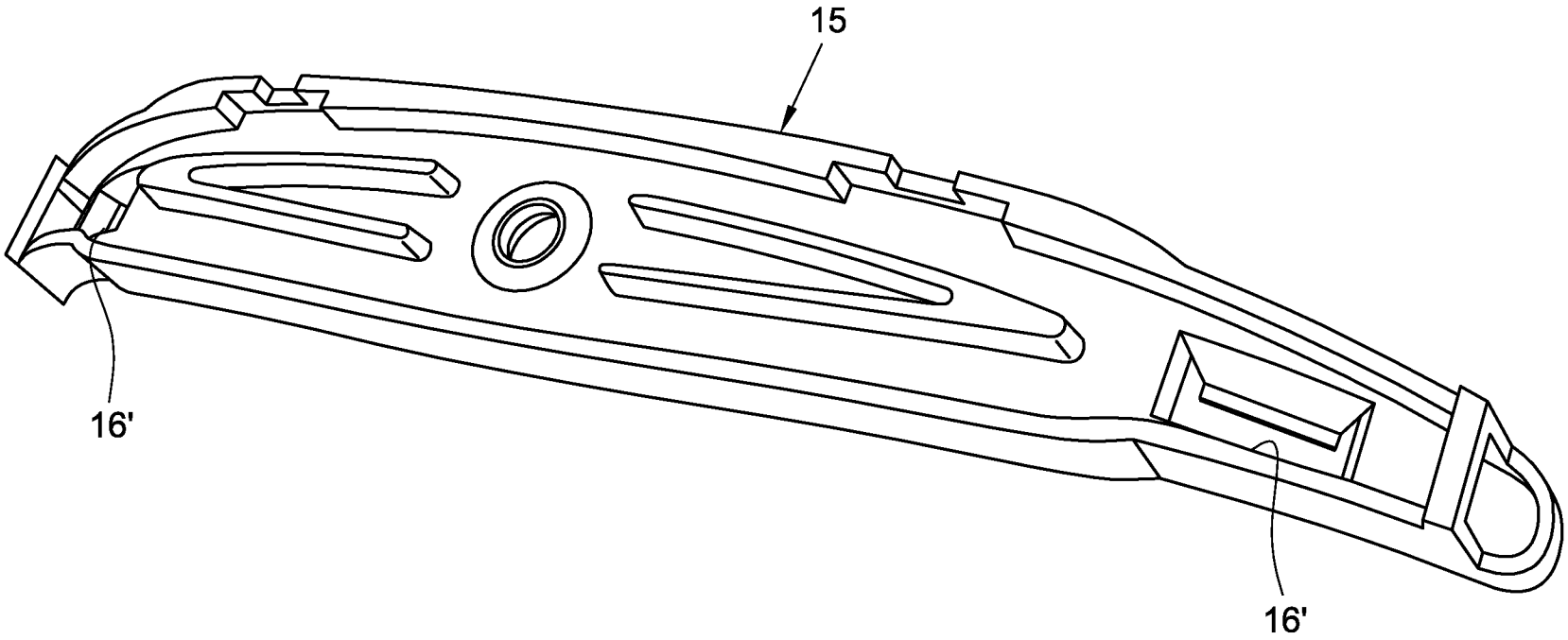

According to the embodiment shown in FIGS. 8-10 the headrest elements 13 can be configured to be oriented just along an axis, in particular the axis of the arms 14.

In order to make such a coupling a cylindrical pin 18' is provided formed on the headrest elements 13 and corresponding cylindrical seats 16' formed on the annular structure 11.

In particular, the cylindrical pin 18' and the seats 16' are shaped to snap-couple.

The peripheral portions 19 of the headrest elements 13, i.e. the portions distal from the side arms 14, comprise gel inserts 20 to offer comfortable support.

Figure 6:
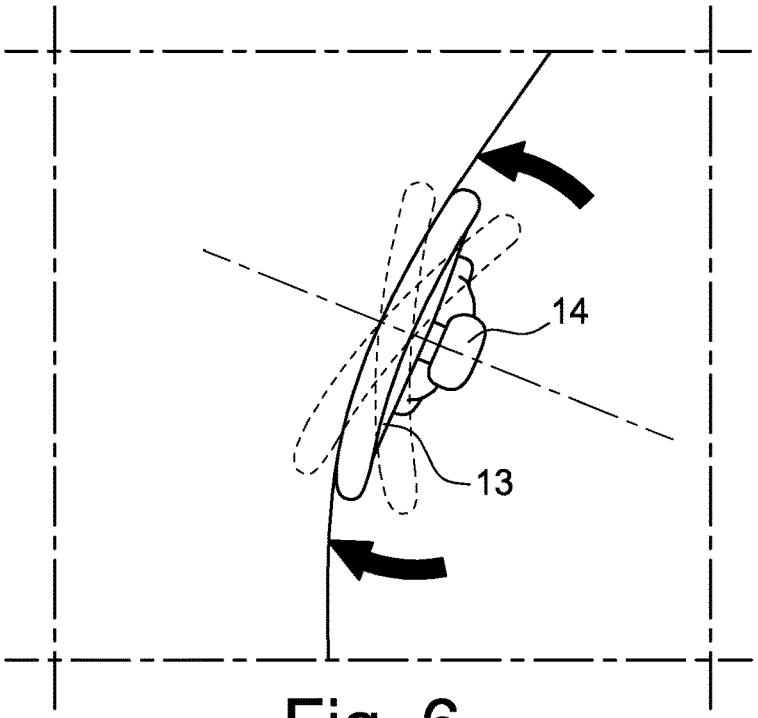
Figure 7:
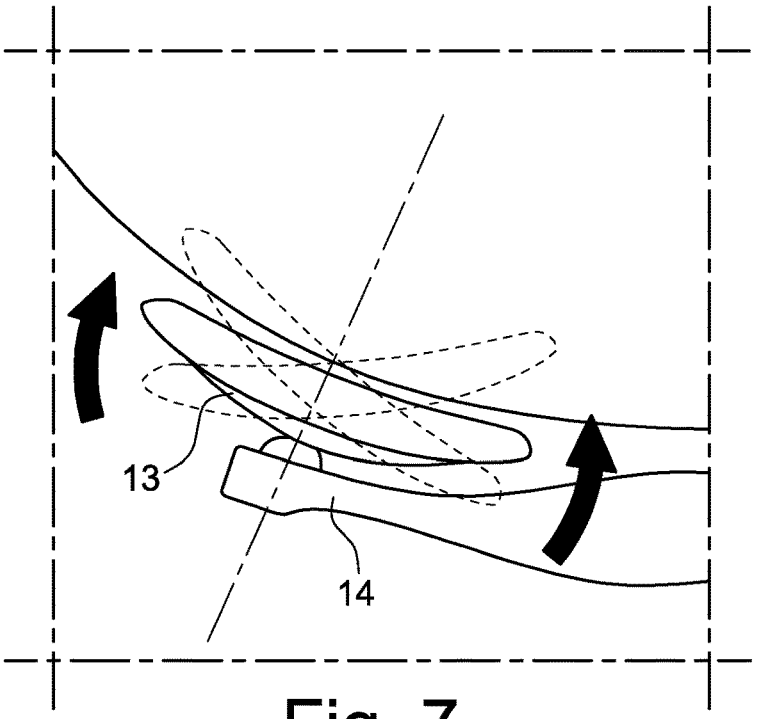

Said support is shown schematically in FIGS. 6 and 7.

Preferably, the headrest elements 13 are replaceable.

It has thus been seen that a size adjuster for helmets for cycling use according to the present invention achieves the purposes outlined earlier.

Indeed, the size adjuster for helmets for cycling use of the present invention offers an alternative solution to the known ones, as well as comfortable support for the user also as the size changes.

The size adjuster for helmets for cycling use of the present invention thus conceived can undergo numerous modifications and variants, all of which are covered by the same inventive concept; moreover, all of the details can be replaced by technically equivalent elements. In practice, the materials used, as well as their sizes, can be whatever according to the technical requirements.

The invention claimed is:

1. Size adjuster for helmets for cycling use of the type that can be fixedly connected inside a helmet for cycling use and comprising:

an annular structure arranged along the lower periphery of said helmet and able to be switched between a minimum diameter configuration and a plurality of increased diameter configurations to allow said helmet to be worn by different sized users, a manual switching device of the configuration of said annular structure, said annular structure comprising a central portion and two side arms able to move telescopically with respect to the central portion by acting on said manual switching device, and headrest elements for a user connected to said annular structure, the annular structure having a plurality of supports, each of said headrest elements having a connecting portion connected at one of said supports, the headrest elements being orientable along all axes in space to adapt to a user's head in all configurations of the adjuster, wherein each of said headrest elements is shaped like a butterfly comprising two lobes connected to a center section of the each of the headrest elements, and the two lobes of the each of said headrest elements are arranged on opposite sides of a respective one of said side arms.

2. Adjuster according to claim 1, wherein said headrest elements are fixedly connected to said side arms.

3. Adjuster according to claim 1, wherein said headrest elements are fixedly connected to said annular structure at spherical supports.

4. Adjuster according to claim 1, wherein the center section of said headrest elements at said side arms is made of rubber with a flexing seat about the axis of said side arms.

5. Adjuster according to claim 4, wherein the peripheral portion of said headrest elements distal from said side arms comprises gel inserts.

6. Adjuster according to claim 1, wherein said headrest elements are replaceable.

7. Adjuster according to claim 1, wherein said headrest elements are orientable along the axis passing through said annular structure, the connecting portion comprising a cylindrical pin and the supports comprise cylindrical seats formed on said annular structure.

8. Adjuster according to claim 1, wherein a position at which each of said connecting portions is connected to said one of said supports is moveable on the annular structure in that each of the connecting portions is fixedly connectable to the supports in a plurality of positions different distances from said manual switching device.

* * * * *